US005762468A

United States Patent [19]

Blotenberg

[11] Patent Number: 5,762,468

[45] Date of Patent: Jun. 9, 1998

[54] PROCESS FOR PROTECTING A TURBOCOMPRESSOR FROM OPERATION IN THE UNSTABLE WORKING RANGE BY MEANS OF FITTINGS WITH TWO DIFFERENT REGULATING SPEEDS

[75] Inventor: Wilfried Blotenberg, Dinslaken, Germany

[73] Assignee: Man Gutehoffnungshütte Aktiengesellschaft, Oberhausen, Germany

[21] Appl. No.: 742,038

[22] Filed: Nov. 1, 1996

[30] Foreign Application Priority Data

Nov. 4, 1995 [DE] Germany ..... 195 41 192.7

[51] Int. Cl.[6] ..... F04D 27/00

[52] U.S. Cl. ..... 415/26; 415/27

[58] Field of Search ..... 415/17, 26, 27, 415/28

[56] References Cited

U.S. PATENT DOCUMENTS

| | | | |
|---|---|---|---|
| 4,789,298 | 12/1988 | Blotenberg . | |
| 4,796,213 | 1/1989 | Blotenberg . | |
| 4,810,163 | 3/1989 | Blotenberg . | |
| 4,831,534 | 5/1989 | Blotenberg . | |
| 4,831,535 | 5/1989 | Blotenberg . | |
| 4,921,399 | 5/1990 | Lew | 415/27 |
| 4,936,740 | 6/1990 | Blotenberg . | |
| 4,938,658 | 7/1990 | Blotenberg . | |
| 4,944,652 | 7/1990 | Blotenberg . | |
| 4,968,215 | 11/1990 | Blotenberg . | |
| 5,242,263 | 9/1993 | Mondoloni | 415/27 |
| 5,290,142 | 3/1994 | Ispas et al. | 415/17 |
| 5,464,318 | 11/1995 | Eklund et al. | 415/28 |

FOREIGN PATENT DOCUMENTS

| | | |
|---|---|---|
| 35 44 821 A1 | 6/1987 | Germany . |
| 38 11 230 A1 | 10/1989 | Germany . |
| 38 11 232 A1 | 10/1989 | Germany . |

*Primary Examiner*—John T. Kwon
*Attorney, Agent, or Firm*—McGlew And Tuttle

[57] ABSTRACT

A process and to a device for protecting a turbocompressor from operating in the unstable working range by means of a blow-off device, wherein a control parameter is determined from measured values for the compressor flow, the compressor final pressure and the temperature measurement, as well as from preset or presettable desired values, and controlled opening of the blow-off fittings is performed by a pump surge limiter by means of a pneumatic actuating device each on the basis of the said control parameter. The measured values for the temperature, flow and pressure entered into the pump surge limiter are coupled with a dynamic blow-off line. The blow-off fittings are operated in sequence, and the control signals for the quick opening of the blow-off fittings are first sent to a small blow-off fitting, and then to a large blow-off fitting after the opening of the small blow-off fitting. In cooperation with the dynamic blow-off line, the pump surge limiter provides for continuous control, i.e., a continuous adjustment of the blow-off fittings as a function of the location of the working point in the characteristic diagram of the turbocompressor.

13 Claims, 3 Drawing Sheets

PROCESS FOR PROTECTING A TURBOCOMPRESSOR FROM OPERATION IN THE UNSTABLE WORKING RANGE BY MEANS OF FITTINGS WITH TWO DIFFERENT REGULATING SPEEDS

FIELD OF THE INVENTION

The present invention pertains to a process for protecting a turbocompressor from operating in the unstable working range by means of a blow-off device, wherein a control parameter is determined from measured values for at least the compressor flow and the compressor final pressure as well as from preset or presettable desired values, and a controlled opening of the blow-off device is performed by a pump surge limiter on the basis of that parameter, as well as to a device which has a pump surge limiter for adjusting the blow-off device by means of an actuating device via a pressurized medium, as well as control lines for actuating the blow-off device in the opening or closing direction.

BACKGROUND OF THE INVENTION

Quickly responding blow-off or blow-by fittings are needed for the optimal protection of turbocompressors from operating in the unstable working range.

Axial compressors are especially at risk during the pumping of the compressor. Hydraulic blow-off or blow-by fittings are preferably used in axial compressors, because the required adjusting times of 1 to 2 sec for an opening movement are guaranteed only by these fittings. These adjusting times can be reached with hydraulic fittings only in the case of quick opening (a solenoid valve in the pressurized oil circuit is actuated and it gradually shuts off the pressurized oil, and the fitting opens at maximum regulating speed) and in the controlled case (the pump surge limiter moves the blow-off fitting into an intermediate position in order to blow off only as much pumping medium as is absolutely necessary) alike. A machine protection control (pump surge limiter) presets a continuous control signal, and the blow-off fitting must assume this preset position as quickly as possible.

A positioning device, which compares the currently measured position with the desired position and generates control/correction interventions in the case of a deviation is necessary in practice. This provides that the desired position of the fitting will be assumed. It has been known that short adjusting times can be achieved with a considerably greater difficulty with a positioning unit than by means of controlled solenoid valves. The valves release a gradual shut-off cross section whose size can be selected, in principle, as desired. The positioning unit must therefore be optimized such that a stable position must be maintained even over a longer period of time. A change in the actual position of the blow-off fitting as a consequence of a change in the correcting variable must take place such that a stable swinging into the new position is guaranteed.

Hydraulically actuated fittings have been known to have the advantage over pneumatically actuated fittings that they permit markedly shorter adjusting times. However, they have the drawback of being markedly more expensive, especially in light of the need for an oil supply unit.

The advantage of hydraulics lies in the incompressibility of the hydraulic oil. Compressed air is compressible and therefore considerably less suited for use as a control medium for quick-acting fittings. While adjusting times of 1 to 2 sec can be reached without problems with hydraulically actuated fittings even in the controlled case, i.e., in the case of an adjustment via the position regulator, this is nearly impossible with pneumatically actuated fittings. The adjusting times that can be realistically reached with pneumatic systems are 2 sec for quick opening and 6 sec for controlled valve movement.

A compressor with a slowly opening fitting (6 sec) can therefore be protected only poorly, a level of protection which is considerably less than a compressor with a quickly opening, hydraulic fitting (1–2 sec).

Another, essential cost factor of the use of blow-off and blow-by fittings for compressors is the design of the fitting. Valves are most suitable, because their characteristics (pressure/flow characteristics) can be adapted to the actual conditions by appropriately designing the valve seats. The valve characteristic can be adapted to the actual conditions of use by design measures.

SUMMARY AND OBJECTS OF THE INVENTION

The primary object of the present invention is therefore to develop a system including a process and a device which guarantee a similarly good opening and closing behavior for protecting a turbocompressor from operating in the unstable working range as in the case of the use of hydraulically driven blow-off fittings.

According to the invention, a process is provided for protecting a turbocompressor from operating in the unstable working range by means of a blow-off device, wherein a control parameter is determined from measured values for at least the compressor flow and the compressor final pressure as well as from preset or presettable desired values. A controlled opening of the blow-off device is performed by a pump surge limiter on the basis of the parameter. The measured values for temperature, flow and pressure, which are sent to a pump surge limiter, are coupled with a dynamic blow-off line, and the two blow-off fittings of the blow-off device are operated in sequence. These control signals are first sent to a small blow-off fitting and then to a large blow-off fitting after the opening of the said small blow-off fitting, for quick opening of the two blow-off fittings. The pump surge limiter receives data from a dynamic blow-off line for determining the movement of the compressor working point in the direction of the pump surge. This blow off line is dynamic as it takes into account the dynamics of the operation, the rate of movement of the working point, including quick as well as slow shifts in the working point (point of operation of the compressor on a working diagram). The dynamic blow off line is similar in operation to control systems using a fixed blow off line (See U.S. Pat. Nos. 4,831,535; 4,789,298; 4,796,213; 4,810,163; 4,944,652 and 4,968,215 which are hereby incorporated by reference). The two blow-off fittings are operated in sequence in the case of slow shifts in the working point, adjusting first the small blow-off fitting and then the large blow-off fitting via I/P converters and position controllers. Both blow-off fittings are adjusted simultaneously in the case of quick shifts in the working point.

The invention further includes a device with a pump surge limiter for adjusting the blow-off device by means of an actuating device via a pressurized medium as well as with control lines for actuating the blow-off device in the opening or closing direction. The blow-off device comprises a small blow-off fitting and a said large blow-off fitting with pneumatic actuating devices. A control component is provided with a dynamic blow-off line, in addition to the pump surge limiter.

The process preferably includes adjusting the blow-off fittings via a solenoid valve during a quick shift in the working point. For controlling disturbance variables, the closing speed of the large blow-off fitting is preferably set to an infinitely high value and is maintained in the assumed open position until the small blow-off fitting is closed completely or nearly completely. For controlling smaller disturbance variables, the large blow-off fitting is preferably set to a slower closing speed than the small blow-off fitting, and the smaller blow-off fitting is the first to reach the range of control due to its higher closing speed. For controlling larger disturbance variables, the large blow-off fitting is preferably moved only after the end position or the vicinity of an end position of the small blow-off fitting has been reached. The position of the final control elements of the blow-off fittings is preferably reported back (feed back) to a gradient limiter.

The gradient limiter is expanded by an additional control component. A return line is provided between the large blow-off fitting as well as the small blow-off fitting, on the one hand, and the control component of the gradient limiter. The solenoid valves of the blow-off fittings are coupled via a control line to the control component with the dynamic blow off line, and the pneumatic actuating devices of the small blow-off fitting are coupled with the pump surge limiter through a control line, and those of the large blow-off fitting are coupled with the pump surge limiter through another control line. The control line and the another control line are preferably each coupled with an I/P converter and a pneumatic control medium is transmitted from a compressed air supply source to the actuating devices.

The small blow-off fitting and the large blow-off fitting are coupled with the gradient limiter and with the control component via a switching signal line. The switching signal line preferably passes over or is split into the control line or through an OR element. The control component with dynamic blow off line is coupled with the control element via a said control line.

The drawback of the prior art is overcome according to the present invention in that a compressor protection system, which operates based on the control principle described below and is equipped with pneumatically actuated fittings, is nearly as effective as a system with prior-art control and with hydraulic blow-off valves.

If the compressor is operated at the normal working point, the flow removed by the process is greater than the flow at the blow-off line, and the adjusting or blow-off fitting is closed. If the flow removed by the process decreases, it may become necessary to blow off part of the compressor throughput via the blow-off fitting in order to guarantee the minimum necessary compressor flow. The pump surge limiter opens the adjusting fitting for this purpose.

A control signal of a control component with a "dynamic blow-off line" is sent according to the present invention simultaneously to the output of a pump surge limiter, which adjusts the blow-off fitting continuously, i.e., at a slow regulating speed, and to a solenoid valve, which initiates a quick opening. This control has the advantage over the process known from U.S. Pat. No. DE 38,11,230 for protecting a turbocompressor by blow-off via a blow-off valve in that with the present invention the full dynamics of all valves is utilized under critical operating conditions (and such critical operating conditions always occur whenever the "dynamic blow-off line" responds).

The command for quick opening is present only as long as the gradient of the working point shift is greater than the distance between the working point and the pump surge, i.e., as long as the critical operating situation is present. If the gradient of the working point shift has decreased as a consequence of the beginning movement of the fitting and has dropped below the limit value, the solenoid valve switches back again, and the fitting returns into the normal controlled operation (closed control circuit). As a result, the fitting is ideally adjusted at a high speed only as long as it is absolutely necessary. The fitting moves into the new stationary working point at the high speed without interruption. However, dead times, inertias, friction effects, etc., act in practice, and they will cause that the fitting will not possibly open wide enough or that it will possibly open too wide. This is subsequently compensated in both cases by the normal control.

It is quite possible and often even the normal case that the "dynamic blow-off line" will respond several times during a disturbance in the process. As was described above, the permissible limit value for the gradient depends on the current distance between the working point and the pump surge, and this distance changes continuously during a shift in the working point caused by a disturbance in the process.

Therefore, the present invention combines favorable costs with the advantages of an inexpensive fitting in a nearly ideal manner.

Flaps can be manufactured for flow control at a markedly lower cost than valves. However, flaps have the drawback of having a highly nonlinear characteristic, which can hardly be influenced by design measures. Even though this shape of the characteristic can be linearized by electronic linearizing circuits, another essential drawback of flaps still persists. This drawback is that flaps have an undefined characteristic in the lower opening range, i.e., at opening angles between 0° and 10° to 20°. Linearization is therefore impossible in this range. In addition, it was reported by manufacturers involved that flaps are generally unsuitable for control in this range. A system—process with a device—which avoids this drawback is therefore shown according to the present invention.

Two regulating flaps, a large one and a small one, are used as the blow-off fitting according to the present invention. The large regulating flap is designed for about 90% of the rated flow, and the small regulating flap is designed for about 10%. A ratio of 80:20 or similar ratios are possible as well. The two regulating flaps are operated in sequence (split range). The small regulating flap is first opened in the case of a response of the pump surge limiter, and the large one will open next. It is achieved due to this selection that the undefined range of the characteristic of the blow-off fitting occurs at very low flows only and thus it is negligible for the practical operation.

Flaps have been known not to have good regulating properties in the range below about 10° opening. This problem is solved according to the present invention by operating a large fitting and a small one in series on the signal side. This means that the small fitting opens first when the output signal of the pump surge limiter decreases (all blow-off/blow-by valves are closed at maximum regulator output signal, and they are open at minimum signal), and the large fitting opens thereafter. By splitting, e.g., into a 10% fitting and a 90% fitting, the critical range with the poor control characteristic is reduced to 10% of the value that would become established with the use of a single 100% fitting. This is sufficient, because the measured signal (flow) is subject to a noise of 1% to 2% caused by the measurement anyway, and this noise is reflected by the correcting variable to the blow-off/blow-by fitting.

The pump surge limiter first opens the small regulating flap for this purpose. If the flow through this fitting is not sufficient to operate the compressor outside the unstable working range, the large regulating flap is subsequently opened as well.

Due to the blow-off fittings being operated in the split range, the adjusting times will increase compared with actuation of a single fitting only or compared with the actuation of both fittings in parallel. The adjusting times double at worst.

This drawback, as well as the above-described drawback of the more slowly controlled adjusting time of pneumatic actuators, are compensated by the control signal of the "dynamic blow-off line" acting simultaneously on all fittings, i.e., on the large and small fittings.

The large flap begins to open as soon as the small flap is fully opened. This large flap is now possibly operated in the range with poor control performance. However, this is noncritical if the regulating speed of the blow-off/blow-by fitting in the closing direction is limited to very low values.

Should the large blow-off fitting exactly assume the necessary position with the necessary throttling behavior due to the intervention of the dynamic blow-off line, no additional control interventions are necessary, and the system displays ideal behavior. However, the large blow-off fitting will usually open too wide or will not open wide enough. If it does not open wide enough or if the throttling action is still too strong, the pump surge limiter will open this blow-off fitting wider. However, if the blow-off fitting has opened too wide or if the throttling action is too weak, the pump surge limiter will execute a closing command.

In another embodiment of the present invention, the closing speed of the large blow-off fitting is limited. This can be performed either by a corresponding setting on the drive of the fitting or by limiting the gradient of the correcting variable in the regulator. The small blow-off fitting can also be provided with a corresponding limitation of the closing speed (it is often necessary for safety reasons), but the large fitting is set to a substantially slower closing speed.

Should the "dynamic blow-off line" have opened the two blow-off fittings too wide, the pump surge limiter executes a closing command. Since the large blow-off fitting is set to a very slow closing speed, it will also close only correspondingly slowly. The small blow-off fitting is set to a higher closing speed and it will again reach the range of control more quickly as a result. As a result, the small fitting has priority during the elimination of smaller process disturbances.

It is also possible to block the closing process of the large blow-off fitting in a controlled manner, i.e., to fix the large regulating flap in the position it has once assumed, until the small blow-off fitting is completely or nearly completely closed. The large blow-off fitting is "frozen" in its position as a result, and smaller disturbance variables are controlled exclusively via the small blow-off fitting. The large blow-off fitting is moved only in the case of larger disturbance variables or when the small blow-off fitting reaches an end position or the vicinity of an end position.

As an alternative, the pump surge limiter and the "dynamic blow-off line" may also control a blow-off device that has only one blow-off fitting, in which case both slow and quick closing processes of the only blow-off fitting are possible.

Exemplary embodiments of the present invention will be explained on the basis of two control circuits and a block diagram.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
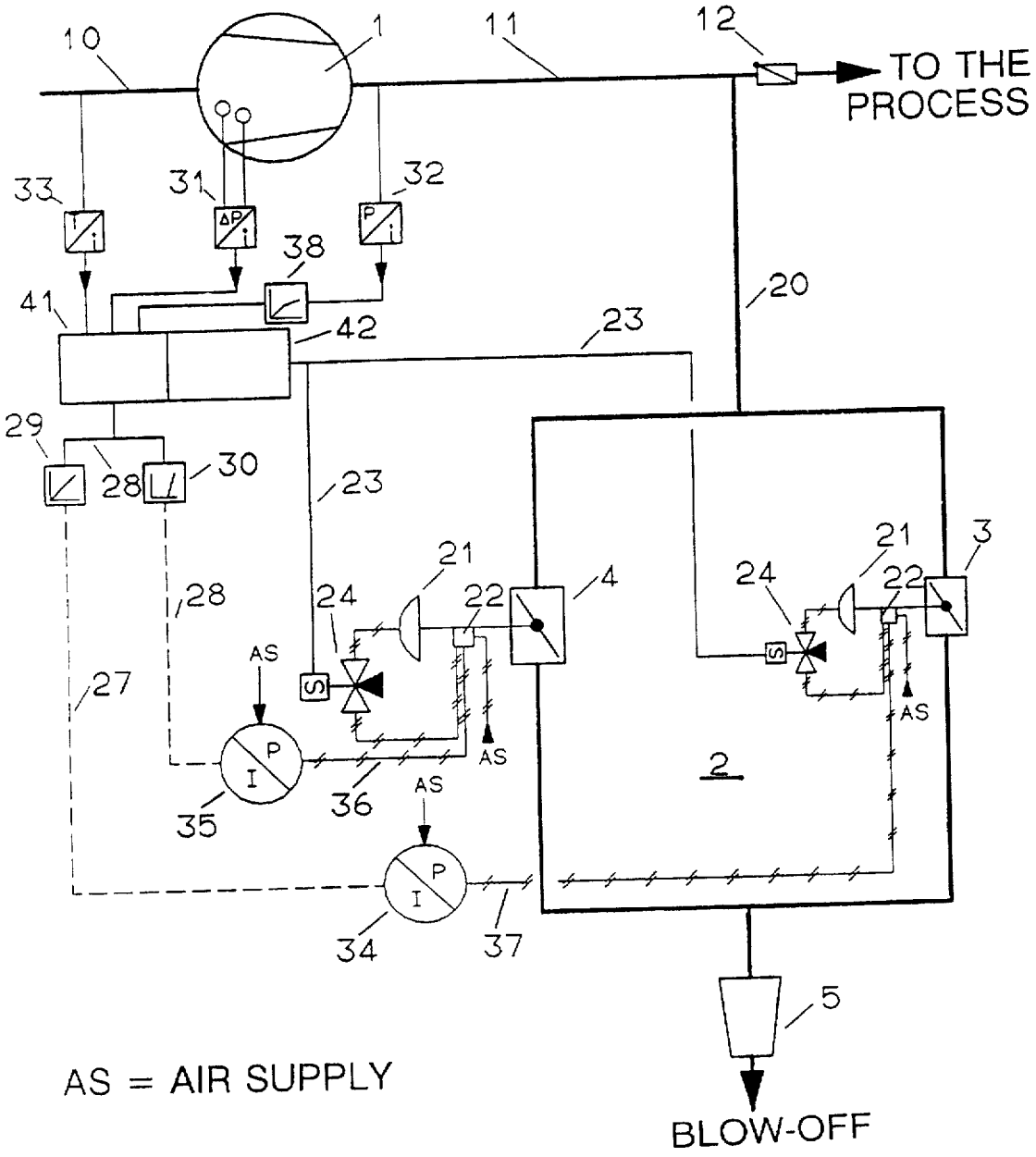
FIG. 1 is a control circuit of a turbocompressor with two blow-off fittings, according to the invention.

Corresponding to FIG. 1, the turbocompressor 1 is connected on the suction side to a suction line 10. On the discharge side, the turbocompressor 1 is connected to a discharge line 11, which sends the medium compressed by the turbocompressor 1 to a downstream process via a nonreturn flap 12. A blow-off line 20 leading to a blow-off device 2 is branched off from the discharge line 11 before the nonreturn flap 12, and two blow-off fittings 3, 4 with a common sound absorber 5 as well as with pneumatic actuating devices 21 and solenoid valves 24, which are connected to two control lines 23, on the one hand, and to the control lines 27 and 28, on the other hand, are arranged in the said blow-off device 2.

The flow of the medium to be compressed, which flows to the compressor 1, is determined on the suction side by means of a flowmeter 31 arranged in the suction opening of the turbocompressor 1. A thermometer 33 is additionally arranged in the suction line 10. The compressor final pressure can be determined by means of a pressure gauge 32 connected to the discharge line 11. The actual value of the flow currently measured by the flowmeter 31 and the desired value of the flow sent by the resolver transmitter 38, as well as the gas temperature measured in the thermometer 33 are sent to a pump surge limiter 41, which is coupled with a "dynamic blow-off line" component 42.

In cooperation with the "dynamic blow-off line" 42, the pump surge limiter 41 provides for continuous control, i.e., for continuous adjustment of the blow-off fittings 3, 4 as a function of the location of the working point in the characteristic diagram. To achieve this, the output of the pump surge limiter 41 acts on the electropnuematic converters 34, 35, which are connected to a pressure supply line 39, via a gradient limiter and via two transformers 29 and 30 as well as via control lines 27, 28. The task of these transformers 29, 30 is to transform the output signal of the pump surge limiter 41 such that the small blow-off fitting 3 will open first, and the large blow-off fitting 4 thereafter. A pressurized medium for opening or closing is admitted via pneumatic control lines 36, 37 to the drives 21, 24 of the small blow-off fitting 3 and of the large blow-off fitting 4 in the blow-off device 2.

A pressurized medium bypass line leads from the actuators 21 to a piston-and-cylinder or diaphragm unit 22 for generating the force for the adjusting movement of the blow-off fittings 3, 4 in the closing and opening directions.

The output of the control lines 27 and 28 acts on the piston-and-cylinder units 22 of the pneumatic actuators 21 via the converters 34, 35. The two blow-off fittings 3, 4 are adjusted as a result in "split range" until the compressor working point is again set back into the safe range of the characteristic diagram.

In the case of greater deviations, the "dynamic blow-off line" 42 energizes the solenoid valves 24 via the control line 23 and initiates a quick opening of both blow-off fittings 3, 4 as a result. Once the process disturbance has extensively subsided, the "dynamic blow-off line" 42 switches back, and the blow-off fittings 3, 4 are adjusted only by control signals of the control lines 27 and 28.

As was explained above, the closing process of the large blow-off fitting 4 can be blocked and this fitting 4 can be fixed in the position it has once assumed until the small blow-off fitting 3 is completely or nearly completely closed. The large blow-off fitting 4 is "frozen" in its position as a result, and the control of smaller disturbance variables is performed exclusively via the small blow-off fitting 3. The large blow-off fitting 4 is moved only in the case of greater disturbance variables or when the smaller blow-off fitting 3 reaches an end position or the vicinity of an end position.

Figure 2:
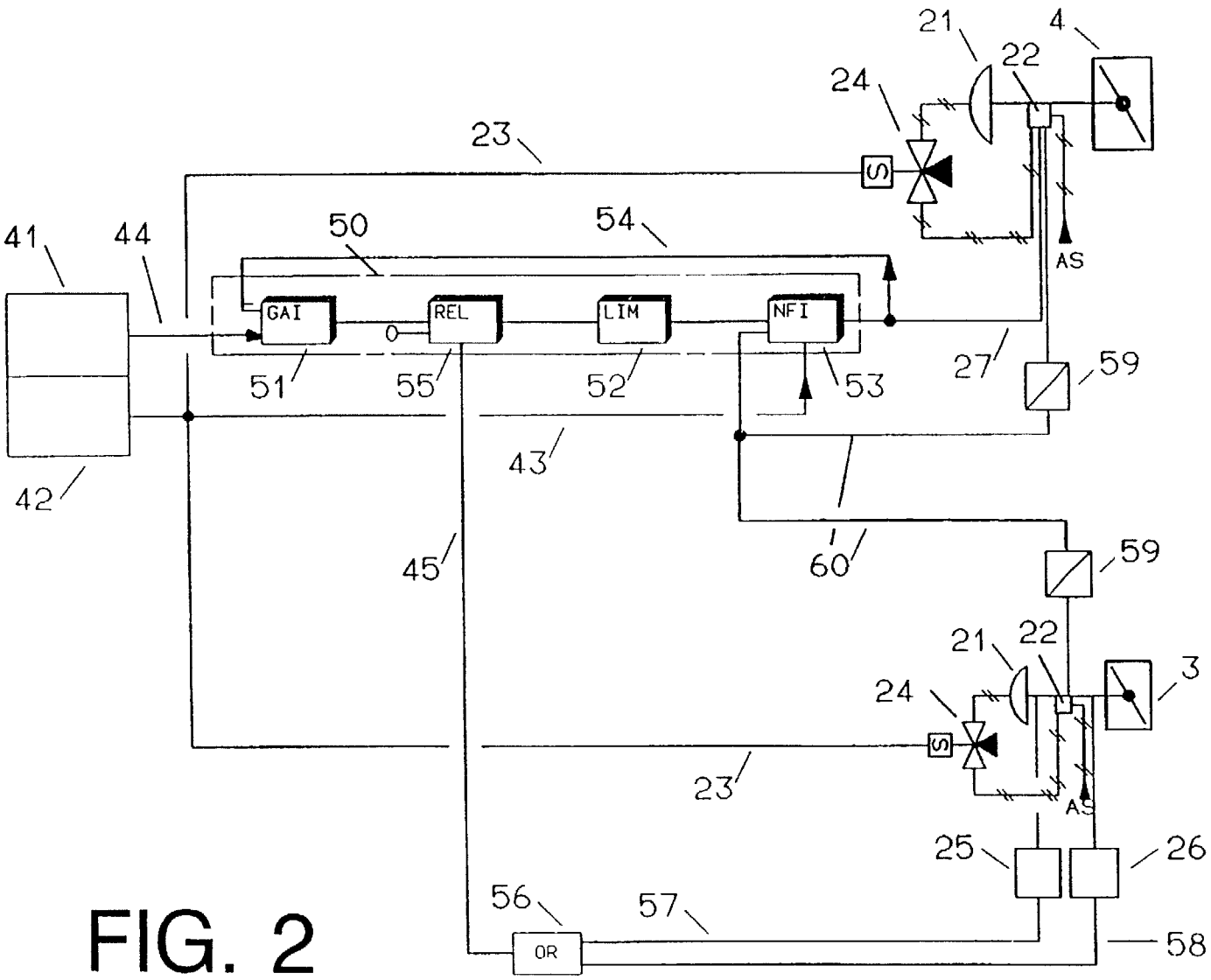
FIG. 2 is a block diagram for controlling the blow-off fittings.

A block diagram of such a structure is shown in FIG. 2.

It shows the components necessary for controlling the small blow-off fitting 3 and the large blow-off fitting 4, which comprise the pump surge limiter 41, the "dynamic blow-off line" 42, as well as the gradient limiter 50 with the corresponding control lines.

The control signal for the large flap 4 is energized via a series connection of various functional blocks of the gradient limiter 50, which was complemented by the relay "REL" 55.

When the "dynamic blow-off line" 42 responds, both solenoid valves 24 are energized via the control line 23, and both blow-off fittings 3, 4 open simultaneously at maximum regulating speed. In addition, the integrator "NFI" 53 is switched to tracking mode, and the memory contents of this integrator 53 are tracked to the currently measured flap position of the large blow-off fitting 4. This can also happen for the small blow-off fitting 3, but this is not shown in FIG. 2. If the quick opening command of the "dynamic blow-off line" 42 disappears, the integrator "NFI" 53 is switched back to the integration mode, and the integrator 53 follows the output signal of the limiter "LIM" 52. The regulating speeds of the blow-off fittings 3, 4 are set in this LIM block 52.

If the small blow-off fitting 3 is outside the end positions, the relay "REL" 55 is switched to zero via the OR element "OR" 56, and the integrator "NFI" 53 remains at its initial value. The adjusting signal of the pump surge limiter 41 to the large blow-off fitting 4 is released only when an end position of the small blow-off fitting 3 is reached, and this large blow-off fitting 4 can follow at the regulating speed set in the block "LIM" 52 or at a lower speed. If the small blow-off fitting 3 again reaches the working range outside the end positions as a result, the relay "REL" 55 is again switched to zero when the end positions are left, and the large blow-off fitting 4 continues to remain in the required position.

It is meaningful to provide the feedback of the end positions of the blow-off fittings 3, 4 by the end position switches 25, 26 with a hysteresis, so that frequent switchovers will be avoided.

The end position feedback can be picked up just as well from the end position switches 25, 26 at the actuator as it can be derived from the position feedback 60 with the position transducer 59.

If a continuous feedback 59 of the measured position of the large blow-off fitting 4 is not available, the output of the integrator NFI 53 can also be fed back to the follow-up input, instead.

Figure 3:
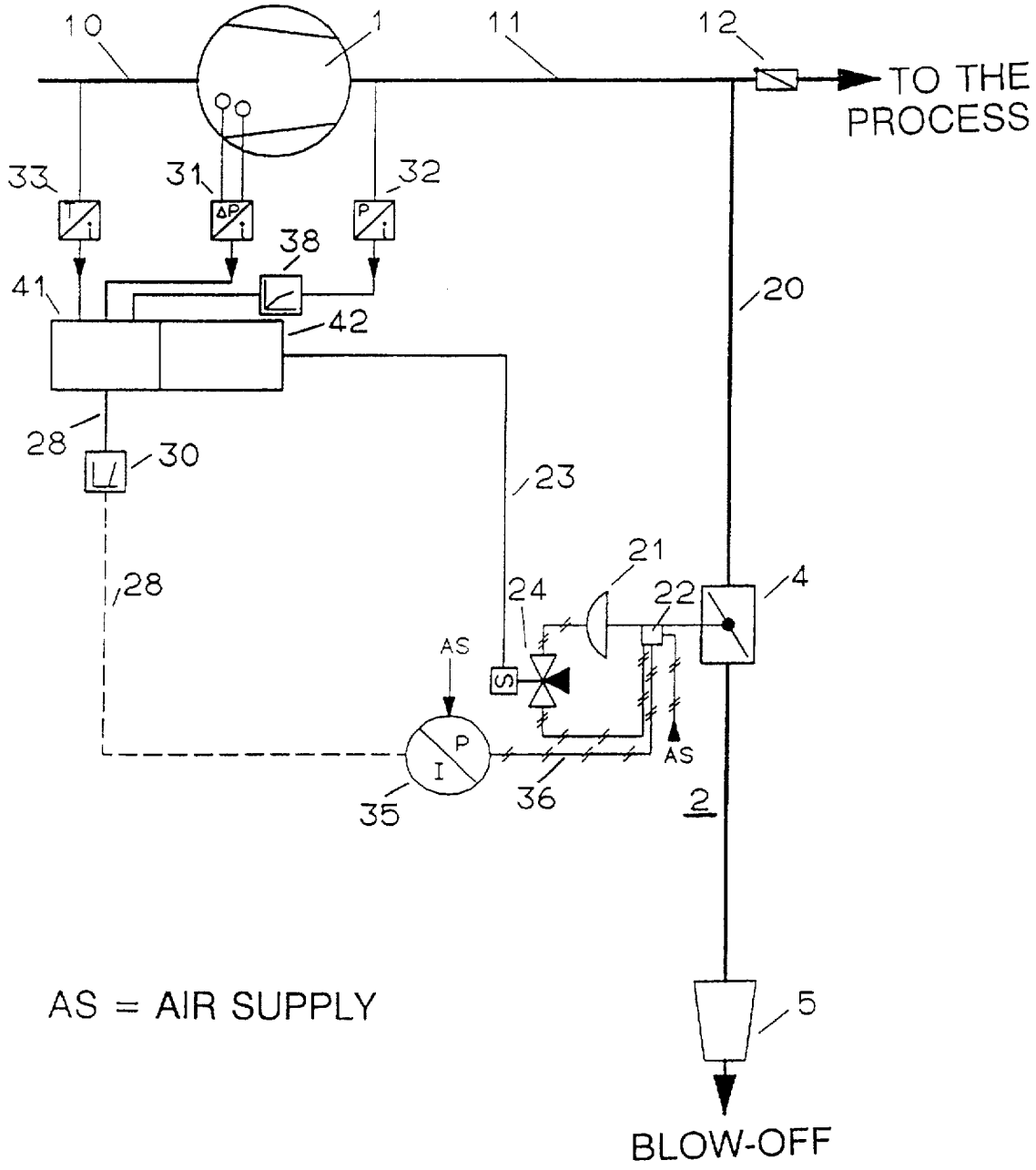
FIG. 3 is a control circuit of a turbocompressor with only one blow-off fitting.

FIG. 3 shows a control circuit of a turbocompressor with only one blow-off fitting. The turbocompressor 1 is connected on the suction side to a suction line 10. The turbocompressor 1 is connected on the discharge side to a discharge line 11, which sends the medium compressed by the turbocompressor 1 to a downstream process via a nonreturn flap 12. A blow-off line 20 to a blow-off device 2 is branched off from the discharge line 11 before the nonreturn flap 12, and a large blow-off fitting 4 with a sound absorber 5 as well as with pneumatic actuating devices 21 and solenoid valves 24, which are connected to the control line 23, on the one hand, and to the control line 28, on the other hand, are arranged in the said blow-off device 2.

The flow of the medium to be compressed, which flows to the compressor 1, is determined on the suction side by means of a flowmeter 31 arranged in the suction opening of the turbocompressor 1 in this case as well. A thermometer 33 is additionally arranged at the suction line 10, and the compressor final pressure is determined by a pressure gauge 32 in the discharge line 11. The actual value of the flow measured by the flowmeter 31 and the desired value of the flow sent by the resolver transmitter 38, as well as the gas temperature measured in the thermometer 33 are sent to a pump surge limiter 41, which is coupled with a "dynamic blow-off line" 42.

In cooperation with the "dynamic blow-off line" 42, the pump surge limiter 41 provides for a continuous control of the blow-off fitting 4 as a function of the location of the working point in the characteristic diagram. To achieve this, the pump surge limiter 41 acts on the electropneumatic converter 35, which is connected to a pressure supply line, via a transformer 30 as well as via the control line 28. The transformer 30 forms the output signal of the pump surge limiter 41 such that the blow-off fitting 4 will open.

A pressurized medium bypass line leads from the actuators 21 to a piston-and-cylinder or diaphragm unit 22 for generating the force for the adjusting movement of the blow-off fitting 4 in the closing and opening directions.

In the case of greater deviations, the "dynamic blow-off line" 42 energizes the solenoid valves 24 via the control line 23 in this case as well, and it initiates a quick opening of the blow-off fitting 4 as a result. Once the process disturbance has extensively subsided, the "dynamic blow-off line" 42 switches back, and the blow-off fitting 4 is adjusted only by control signals of the control line 28.

While specific embodiments of the invention have been shown and described in detail to illustrate the application of the principles of the invention, it will be understood that the invention may be embodied otherwise without departing from such principles.

What is claimed is:

1. A method for protecting a turbocompressor from operating in unstable working range by means of a blow-off device, wherein a control parameter is determined from measured values for at least the compressor flow and the compressor final pressure as well as from preset or presettable desired values, and controlled opening of the blow-off device is performed by an anti surge controller on the basis of the said parameter, comprising the steps of:

measuring values for temperature, flow and pressure;

sending the measured values to the anti surge controller;

coupling the anti surge controller with a dynamic blow-off line means;

operating two blow-off valves of the blow-off device in sequence by sending control signals to the two blow-off valves of the blow-off device, wherein said control signals are first sent to a smaller blow-off valve of the two blow-off valves of the blow-off device for quick opening of the two blow-off valves, and then to a larger blow-off valve of the two blow-off valve of the blow-off device after the opening of the said small blow-off valve;

receiving, at the anti surge controller, data from a dynamic blow-off line means for determining the movement of the compressor working point in the direction of the pump surge;

operating the two blow-off valves in sequence in the case of slow shifts in the working point, including adjusting first the small blow-off valve and subsequently adjusting the large blow-off valve; and adjusting the blow-off valves simultaneously in the case of quick shifts of the working point.

2. A method in accordance with claim 1, wherein said blow-off valves are adjusted via a solenoid valve during a quick shift in the working point.

3. A method in accordance with claim 1, wherein the closing speed of the larger blow-off valve is set to an infinitely low value and is maintained in the assumed position as long as the dynamic blow-off line did not ask for rapid opening until the small blow-off fitting is closed completely or nearly completely for controlling disturbance variables.

4. A method in accordance with claim 1, wherein:

the larger blow-off valve is set to a slower closing speed than the small blow-off valve for controlling smaller disturbance variables.

5. A method in accordance with claim 1, wherein the larger blow-off valve is moved only after the end position or the vicinity of an end position of the small blow-off valve has been reached except for controlling larger disturbance variables.

6. A method in accordance with claim 1, wherein the position of the final control elements of the blow-off valves is reported back to a gradient limiter.

7. A device for protecting a turbocompressor from operating in unstable working range by means of a blow-off device, comprising:

measuring means for determining a control parameter from measured values for at least the compressor flow and the compressor final pressure as well as from preset or presettable desired values;

a anti surge controller, said measured values being sent to said anti surge controller;

control component means including a dynamic blow off line, said control component means being coupled to said anti surge controller, said control component means providing said anti surge controller with data from a dynamic blow-off line for determining the movement of a compressor working point in the direction of pump surge;

a blow-off device connected to an outlet of the turbocompressor, including a small blow-off valve and a large blow-off valve, said large blow off valve being larger than said small blow off valve, said small blow-off valve and said large blow-off valve having pneumatic or hydraulic actuating devices operating two blow-off valves of the blow-off device in sequence by sending control signals to the two blow-off valves of the blow-off device, wherein said control signals are first sent to said small blow-off valve of the two blow-off valves of the blow-off device for quick opening of the two blow-off valves, and then to said large blow-off valve of the two blow-off valves of the blow-off device after the opening of said small blow-off valve whereby the two blow-off valves are operated in sequence in the case of slow shifts in the working point, including adjusting first the small blow-off valve and subsequently adjusting the large blow-off valve and adjusting the blow-off valves simultaneously in the case of quick shifts in the working point.

8. A device in accordance with claim 7, further comprising a gradient limiter with a control component and an additional control component, said gradient limiter being expanded by said additional control component, and a return line provided between said large blow-off valve as well as the said small blow-off valve and said control component of the said gradient limiter.

9. A device in accordance with claim 7, wherein said blow off device comprises solenoid valves coupled via a control line to said control component means, and said pneumatic or hydraulic actuating devices of said small blow-off valve are coupled with the said anti surge controller through a first anti surge control line, and said pneumatic or hydraulic actuating devices of the said large blow-off valve are coupled with said anti surge controller through a second anti surge control line.

10. A device in accordance with claim 9, wherein said first and second anti surge controller are each coupled with I/P converters and a pneumatic or hydraulic control medium is transmitted from a compressed air or oil supply source to actuating devices.

11. A device in accordance with claim 8, further comprising a switching signal line wherein said small blow-off valve and said large blow-off fitting are coupled with said gradient limiter and with said control component means via said switching signal line.

12. A device in accordance with claim 11, wherein said switching signal line passes over or is merged into said control line through one of an OR element.

13. A device in accordance with claim 8, said control component means is coupled with the said control element via said control line.

* * * * *